US006807389B2

(12) United States Patent
Facci et al.

(10) Patent No.: US 6,807,389 B2
(45) Date of Patent: Oct. 19, 2004

(54) BIAS CHARGE ROLLER WITH OPTIMALLY INDUCED AC CORONA

(75) Inventors: John S. Facci, Webster, NY (US); Michael J. Levy, Webster, NY (US); Paul W. Morehouse, Jr., Webster, NY (US); Rachael L. McGrath, Chruchville, NY (US)

(73) Assignee: Xerox Corporation, Stamford, CT (US)

( * ) Notice: Subject to any disclaimer, the term of this patent is extended or adjusted under 35 U.S.C. 154(b) by 9 days.

(21) Appl. No.: 10/319,201

(22) Filed: Dec. 13, 2002

(65) Prior Publication Data

US 2004/0114956 A1 Jun. 17, 2004

(51) Int. Cl.[7] ..... G03G 15/00; H05F 3/00

(52) U.S. Cl. ..... 399/89; 361/225

(58) Field of Search ..... 399/50, 66, 89, 399/168, 174, 175, 176, 297, 310, 313, 314, 315; 361/225

(56) References Cited

U.S. PATENT DOCUMENTS 3,575,502 A * 4/1971 Eppe ..... 399/315
4,699,499 A * 10/1987 Hoshika et al. ..... 399/315
4,739,363 A * 4/1988 Hoshika et al. ..... 399/315
4,851,960 A 7/1989 Nakamura et al. ..... 361/225
5,006,902 A * 4/1991 Araya ..... 399/168
5,132,738 A * 7/1992 Nakamura et al. ..... 399/314 X
5,412,455 A 5/1995 Ono et al. ..... 355/219
5,426,488 A * 6/1995 Hayakawa et al. ..... 399/174
5,613,173 A 3/1997 Kunzmann et al. ..... 399/89
5,832,346 A * 11/1998 Lewis ..... 399/168
5,842,081 A * 11/1998 Kaname et al. ..... 399/50
6,035,163 A 3/2000 Zona et al. ..... 399/176
6,505,013 B1 * 1/2003 Bedford et al. ..... 399/50

* cited by examiner

*Primary Examiner*—Sandra L. Brase
(74) *Attorney, Agent, or Firm*—Richard F. Spooner

(57) ABSTRACT

An apparatus and process for applying an electrical charge to a photoreceptor wherein a bias charge roll member is situated in contact or in close proximity with a surface of a member to be charged such as a photoreceptor. The bias charge roll member is supplied with an electrical bias having a variable voltage waveform onto which a DC bias is superimposed. The amount of DC bias is selected to set the signal voltage such that a minimally acceptable amount of AC corona is created sufficient for uniform photoreceptor charging while avoiding unnecessary excessive positive corona that causes excessive photoreceptor wear.

21 Claims, 5 Drawing Sheets

BIAS CHARGE ROLLER WITH OPTIMALLY INDUCED AC CORONA

CROSS-REFERENCE TO RELATED APPLICATIONS

Reference is made to commonly-assigned co-pending U.S. patent application Ser. No. 10/319,172, filed herewith, entitled INTERMITTENT DC BIAS CHARGE ROLL WITH DC OFFSET VOLTAGE, by Facci, et al, the disclosures of which are incorporated herein.

FIELD OF THE INVENTION

The present invention relates generally to a roller apparatus for generating a substantially uniform charge on a surface, and, more particularly, concerns a biased roll charging apparatus having a clipped AC input voltage with a DC offset voltage.

BACKGROUND AND SUMMARY

When used to charge an imaging member, a roller used to create a charge on a another surface or substrate is commonly referred to as bias charge roll ("BCR"). When used to charge a substrate to enable transfer of a developed image from an imaging member to a substrate member, a roller used to create such bias charging is commonly referred to as a bias transfer roll ("BTR"). Although both may differ in details particular to their applications, both represent illustrative embodiments of the present invention.

Generally, the process of electrostatographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrostatographic reproduction process is well known and is useful for both digital copying and printing as well as for light lens copying from an original. In many of these applications, the process described above operates to form a latent image on an imaging member by discharge of the charge in locations in which light from a lens, laser, or LED discharges a charge. Such printing processes typically develop toner on the discharged area, known as DAD, or "write black" systems. Light lens generated image systems typically develop toner on the charged areas, known as CAD, or "write white" systems. The embodiments of the present invention apply to both DAD and CAD systems.

With respect to BCR applications, those skilled in the art recognize that various devices and apparatus have been proposed for creating a uniform electrostatic charge or charge potential on a photoconductive surface prior to the formation of the latent image thereon. Generally, corona generating devices are utilized to apply a charge to the photoreceptive member. In a typical device, a suspended electrode, or so-called coronode, comprising a thin conductive wire is partially surrounded by a conductive shield with the device being situated in close proximity to the photoconductive surface. The coronode is electrically biased to a high voltage potential, causing ionization of surrounding air which results in the deposit of an electrical charge on an adjacent surface, namely the photoconductive surface of the photoreceptive member. Corona generating devices are well known, as described, for example, in U.S. Pat. No. 2,836,725, to R. G. Vyverberg, among numerous other patents and publications. In the referenced Vyverberg patent, the coronode is provided with a DC voltage, while the conductive shield is usually electrically grounded and the photoconductive surface to be charged is mounted on a grounded substrate, spaced from the coronode opposite the shield. Alternatively, the corona device may be biased in a manner taught in U.S. Pat. No. 2,879,395, wherein the flow of ions from the electrode to the photoconductive surface is regulated by an AC corona generating potential applied to the conductive wire electrode and a DC potential applied to the conductive shield partially surrounding the electrode. The DC potential allows the charge rate to be adjusted, making this biasing system ideal for selfregulating systems. Various other corona generating biasing arrangements are known in the art and will not be discussed in great detail herein.

Several problems have historically been associated with corona generating devices. One problem includes the use of very high voltages (3000–8000 V), requiring the use of special insulation, inordinate maintenance of corotron wires, low charging efficiency, the need for erase lamps and lamp shields and the like, arcing caused by non-uniformities between the coronode and the surface being charged, vibration and sagging of corona generating wires, contamination of corona wires, and, in general, inconsistent charging performance due to the effects of humidity and airborne chemical contaminants on the corona generating device. More importantly, corotron devices generate ozone, resulting in well-documented health and environmental hazards. Corona charging devices also generate oxides of nitrogen which eventually desorb from the corotron and oxidize various machine components, resulting in an adverse effect on the quality of the final output print produced thereby.

As an alternative to corona generating devices used in charging systems, roll charging systems such as BCR's and BTR's have been developed and incorporated into various machine environments with limited success. BCR charging systems are exemplified by U.S. Pat. No. 2,912,586, (R. W. Gundlach); U.S. Pat. No. 3,043,684, (E. F. Mayer); U.S. Pat. No. 3,398,336, (R. W. Martel et al.); U.S. Pat. No. 3,684,364, (F. W. Schmidlin); and U.S. Pat. No. 3,702,482, (Dolcimascolo et al.), among others, wherein an electrically biased charging roller is placed in contact with the surface to be charged, e.g. the photoreceptive member. Also relevant is U.S. Pat. No. 5,412,455, to Ono et al. wherein a charging device includes: a member to be charged; a charging member connectable to the member to be charged; a power source for supplying an oscillating voltage to the charging member; and a constant voltage element connected electrically in parallel with the power source for generating the oscillating voltage. Also, U.S. Pat. No. 5,463,450, to Inoue et al. discloses a charging apparatus for electrically charging a member to be charged including a charging member contactable to the member to be charged. The member to be charged includes a core and a voltage source for applying an oscillating voltage between the member to be charged and the charging member, wherein the frequency of the oscillating voltage satisfies a predetermined condition. Each of these is hereby incorporated by reference in their entirety.

In BCR charging systems, a charging member in the form of a roller is contacted with the surface of the photoreceptive member or other member to be charged, and an oscillating input voltage, typically a DC biased AC voltage signal, is applied to the roller to generate an oscillating electric field for applying a charge potential of a given polarity, to the photoreceptive member where the DC offset defines the polarity of the charge applied. Although the input voltage may be comprised solely of a DC component, an oscillating voltage such as an AC voltage signal having a DC voltage signal superimposed thereon has been found to be preferable with respect to charge uniformity. See, for example, U.S. Pat. No. 4,851,960 to Nakamura et al which teaches that peak-to-peak input voltage, Vp–p, for DC-biased AC wave is form should be at least twice the charge starting voltage for the photoreceptor or other charge receptor in the system being charged.

The absence of charge uniformity tends to manifest itself in the form of periodic stripes or so-called strobing corresponding to the variation in charge potential on the photoconductive surface. This strobing effect causes variations in toner attraction during development and often results in significant image quality degradation. However, an oscillating input voltage contributes both positive and negative polarity charges to the photoconductive surface. This results in a charging system that requires relatively high charging and discharging currents which, in turn, has a negative effect on the functional life of the photoreceptive member. Also, high oscillating charging voltage induces complementary corona charges. Experience indicates that positive corona charges coupled with oscillating discharge increase photoreceptor member wear. Thus, a significant disadvantage of most biased roll charging systems is the resulting rapid wear of the photoconductive surface caused by the electrical discharge from the bias charge roll during the charging process. A related cause for rapid wear appears to be chemical degradation of organic and other complex molecules coupled with repetitive wiping or scraping of the photoreceptor layers by cleaning blades or other cleaning members.

One partial solution to the above problems is found in U.S. Pat. No. 5,613,173, issued to Kunzmann et al., hereby incorporated by reference in its entirety. In Kunzmann, a BCR apparatus is disclosed having clipped AC input voltage to reduce the phenomenon of strobing while also reducing photoreceptor wear caused by the electrical discharge from the bias charge roll during the charging process. The clipping of the AC oscillating voltage removes one polarity from the input signal, thereby supplying a single polarity to the photoreceptor or other charged member and, as a result, enabling sufficient charging at lower voltages applied to the charged surface. Such lower voltages extend photoreceptor life, in part by reducing electrically induced chemical damage.

Testing and experience has shown that the clipped AC BCR invention of Kunzmann increases photoreceptor life by approximately 15–40% when compared to unclipped AC BCR systems of the same peak voltage, current, and oscillating frequency. Since photoreceptor life is one of the primary parameters establishing the useful life of a typical customer replaceable cartridge (CRU) containing a photoreceptor, further extensions of photoreceptor life directly extend CRU life cycles and, thereby, significantly affect overall cost of ownership of electrophotographic printing systems using BCR systems.

Although Kunzmann describes a BCR system that improves photoreceptor useful life by decreasing photoreceptor wear, it would be advantageous to create a BCR system that greatly improves photoreceptor useful life even more than the invention in Kunzmann.

In accordance with another aspect of the invention, an electrostatographic printing machine including a charging device for applying an electrical charge to an imaging member is provided, comprising: (a) a member to be charged; (b) a charge roll member situated proximately to a surface of the member to be charged; (c) a power supply for supplying an oscillating voltage signal to the charge roll member; and (d) a device for removing a selected polarity component of the oscillating voltage signal, thereby supplying a voltage signal to the charge roll member comprised of a rectified waveform with a DC bias offset; wherein a first and second Paschen threshold voltages exist between the charge roll member and the member to be charged; wherein a portion of the voltage signal exceeds the first Paschen threshold voltage, thereby inducing a corona of the same polarity as the rectified waveform, and wherein a portion of the voltage signal exceeds the second Paschen threshold voltage, thereby inducing a corona of the opposite polarity of the rectified waveform.

In accordance with another aspect of the invention, an apparatus for applying an electrical charge to a member to be charged is provided, comprising: (a) a charge roll member situated proximately to a surface of the member to be charged; and (b) a power supply for supplying an oscillating polarity voltage signal to the member to be charged; wherein a first and a second Paschen threshold voltage exist between the charge roll member and the member to be charged; wherein a portion of the voltage signal exceeds the first Paschen threshold voltage, thereby inducing a first corona of the same polarity as the portion of the voltage signal that exceeds the first Paschen threshold voltage; and wherein a portion of the voltage signal exceeds the second Paschen threshold voltage by not more than about 200 volts, thereby inducing a corona of opposite polarity from the first corona.

In accordance with the present Invention, an apparatus for applying an electrical charge to a member to be charged is provided, comprising: (a) a charge roll member situated proximately to a surface of the member to be charged; (b) a power supply for supplying an oscillating voltage signal to the charge roll member; (c) a device, interposed between the power supply and the charge roll member, for removing a selected polarity component of the oscillating voltage signal, thereby supplying a voltage signal to the charge roll member comprised of a rectified waveform with a DC bias offset; wherein a first and a second Paschen threshold voltage exist between the charge roll member and the member to be charged; wherein a portion of the voltage signal exceeds the first Paschen threshold voltage, thereby inducing a corona of the same polarity as the rectified waveform, and wherein a portion of the voltage signal exceeds the second Paschen threshold voltage, thereby inducing a corona of the opposite polarity of the rectified waveform.

In accordance with another aspect of the Invention, a process for applying an electrical charge to a member to be charged is provided, comprising: determining a first relationship between the voltage potential of the member to be charged and various levels direct current voltage signals supplied to a charge roll member situated in proximity to a surface of the member to be charged; selecting a desired level of voltage potential of the member to be charged; identifying a second relationship between the voltage potential of the member to be charged and various levels of Input voltage signals that comprise variable voltage components in which a portion of the voltage signal exceeds the second Paschen threshold voltage, said variable voltage signals being supplied to the charge roll member situated in proximity to a surface of the member to be charged; combining the first relationship and the second relationship to determine various variable voltage signals that achieve the selected desired level of voltage potential of the member to be charged; choosing the variable voltage signal that provides essentially minimally sufficient alternating polarity corona for uniformly charging the member to be charged.

BRIEF DESCRIPTION OF THE DRAWINGS

These and other aspects of the present invention will become apparent from the following description in conjunction with the accompanying drawings in which.

DESCRIPTION

Figure 1:
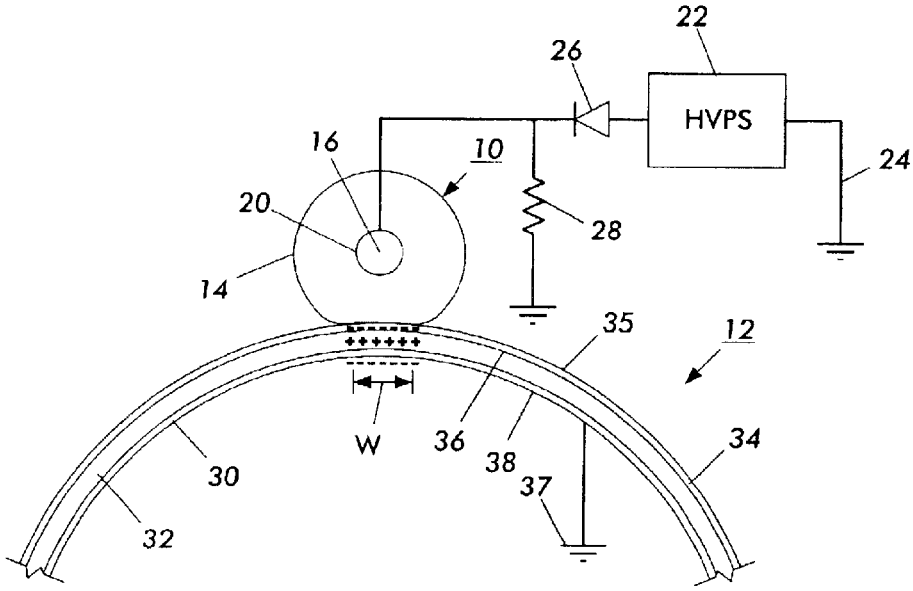
FIG. 1 PRIOR ART
FIG. 1 is a partial schematic view of a biased roll charging system showing the electrostatic operation of a charging system of the prior art.

For a general understanding of the features of the present invention, reference is made to the drawings wherein like reference numerals have been used throughout to designate identical elements.

It will be recognized, that while the present invention describes a charging system for a typical BCR used in an electrostatographic printer, embodiments of the present invention are equally well suited for use in a wide variety of other electrostatographic-type processing machines, in BTR applications, and in other applications in which uniform charges are to be placed upon moving surfaces. The disclosed invention is not limited in its application to the particular embodiment or embodiments shown herein. In particular, it should be noted that the charging apparatus of the present invention, described with reference to an exemplary charging system, may also be used in a transfer, detack, or cleaning subsystem of a typical electrostatographic apparatus since such subsystems may also require the use of a charging device. In addition, it will be recognized that a biased roll charging system may have equal application for applying an electrical charge to a member other than a photoreceptor and/or in environments outside the realm of electrostatographic printing.

Referring initially to FIG. 1, one embodiment of a biased roll charging system is shown in the context of an exemplary electrostatographic reproducing apparatus, employing a drum 12 including a photoconductive surface 35 deposited on an electrically grounded conductive substrate 38. The embodiment in FIG. 1 is copied from U.S. Pat. No. 5,613,173, issued to Kunzmann, and exemplifies basic operation of a prior art biased roll charging system. A motor (not shown) engages with drum 12 for rotating the drum 12 to advance successive portions of photoconductive surface 35 through various processing stations disposed about the path of movement thereof, as is well known in the art. Initially, a portion of drum 12 passes through a charging station where a charging device in accordance with the present invention, indicated generally by reference numeral 10, charges the photoconductive surface on drum 12 to a relatively high, substantially uniform potential.

Referring now, more particularly, to the bias roll charging system 10, a conductive roll member 14 is provided in contacting engagement with the photoreceptor member 12. The conductive roll member 14 is axially supported on a conductive core or shaft 20, situated transverse to the direction of relative movement of the photoreceptor member 12. In one embodiment, the roll member 14 is provided in the form of a deformable, elongated roller supported for rotation about an axis 16 and is preferably comprised of a polymer material such as, for example, neoprene, E.P.D.M. rubber, Hypalon® rubber, nitrile rubber, polyurethane rubber (polyester type), polyurethane rubber (polyether type), silicone rubber, Viton®/Fluorel® rubber, epichlorohydrin rubber, or other similar materials having a DC volume resistivity in the range of $10^3$ to $10^7$ ohm-cm after suitable compounding with carbon particles, graphite or other conductive additives. These materials are chosen for the characteristic of providing a deformable structure while in close proximity or contact with the photoreceptor member, as well as wearability, manufacturability and economy. The deformability of the roller member 14 is important to provide a nip having a substantially measurable width W while being engaged with the photoreceptor 12.

A high voltage power supply 22 with ground 24 is connected to roll member 14 via shaft 20 for supplying an oscillating input drive voltage to the roll member 14. While it is possible to use a standard line voltage, other voltage levels or voltage signal frequencies may be desirable in accordance with other limiting factors dependent on individual machine design such as the desired charge level to be induced on the photoreceptor or the speed of imaging operations desired. The oscillating Input voltage and circuit connecting the power supply 22 to shaft 20 is discussed in greater detail below.

With particular regard to biased roll charging, a suitable photoreceptive member 12 has the property of injecting a single sign of mobile carriers from a charge generating layer into a charge transport layer such that a surface charge potential having only a single charge polarity is generated on the surface of the photoreceptor member, irrespective of the inducing voltage signal applied to roll member 14. With reference to FIG. 1, the photoreceptive member 12 generally includes a conductive substrate 38, such as an aluminum sheet connected to a ground potential 37, a charge generating layer 30, a charge transport layer 32 comprising a photoconductive insulator such as selenium or any of a variety of organic compositions, and, optionally, an overcoating 34, forming the outer surface 35 of the photoreceptor member. The charging operation involves the application of the AC voltage signal from the bias charging system 10 to the photoconductive surface of photoreceptor 12, which creates a voltage potential across the photoreceptor to ground 37. Charge carriers from the charge generating layer 30 migrate into the bulk of the charge transport layer 32 to the upper surface 36 of the photoconductive material, where the charge will be trapped. When the AC voltage signal from voltage source 22 is of a negative polarity, as indicated by the minus signs (–) along the lowermost portion of roller member 14, in contact with the outer surface 35 of photoreceptor member 12, a positive charge indicated by plus signs (+) is induced near the upper surface 38 of the photoconductive material layer, suitable for charging the photoreceptor member in preparation for imaging. The thin overcoating 34 is desirable on either the roller member 14 or the photoreceptor 12 for a variety of reasons, including protection of the surfaces of roller member 14 or photoreceptor 12, or for a BCR current limiting action which may allow the use of low resistivity rollers, or for photoreceptor or roil member surface property control. In the embodiment shown In the drawings, overcoating 34 Is provided on the upper surface of the photoreceptor. Alternatively, an overcoating may be provided on the outer surface of bias roll member 14 for the same effect.

Strobing (i.e. successive areas of varying voltage characteristics) has at least two causes. It can be caused by inducing a charge on a first photoreceptor surface portion by providing roller member 14 in contact with that portion during a period of the AC voltage signal passing through a selected polarity, while in a succeeding photoreceptor surface portion, inducing no charge because the AC voltage signal is passing through a period of non-selected polarity while roller member 14 is in contact with that portion of the photoreceptor surface. Accordingly, in order to provide a uniform charge on the photoreceptor surface, each incremental portion of the photoreceptor member surface must be contacted during a period of charging, or a period wherein the polarity of the driving voltage is of the selected polarity for charging. Thus, a given area of the rubber roller 14, the nip, should be maintained in contact with any selected surface portion for a period greater than the period of the driving voltage frequency. Varying nip widths may be provided by varying the materials used for the roller. In most cases, the allowable relative speed of the bias roller and the photoreceptor surface is varied in compensation for the varied nip width to prevent strobing. It will, of course, be appreciated that the time required for charging a photoreceptor to a given voltage level depends on the physics of the charge transfer process. In other words, charging for a predetermined period is sufficient to charge the photoreceptor to a desired voltage level.

U.S. Patent No., issued to Kunzmann and discussed above, discusses the problems resulting from using a simple DC offset AC waveform from power supply 22 to shaft 20. Specifically, the use of a DC offset AC waveform contributes both positive and negative charge to the photoreceptor member. Since the photoreceptive member 12 has the property of injecting only a single sign of mobile carriers from a charge generating layer to induce the generation of only a single charge polarity, a significant disadvantage of DC offset AC waveform bias charge roll systems results from the fact that both negative and positive charge application results from an AC input drive voltage unless the DC offset exceeds the amplitude of the pulse. A relatively high DC offset bias is required in order to create a current with only one polarity. A high AC bias current, in particular the positive component of an AC bias current, results in degradation and rapid wear of the photoreceptor charge transport layer due to the electrical discharge of the bias Charge roller as the photoreceptor member is being charged. The solution in Kunzmann is to clip, or rectify, the AC current, thereby providing a single polarity oscillating input drive voltage supplied to the bias charge roller. This approach allows a reduced total applied voltage to the bias roll system without limiting the resulting surface charge potential and its uniformity.

One specific embodiment described in Kunzmann is embodied in the electrical circuit shown in FIG. 1. In this embodiment, a simple diode/resistor circuit 26, 28 is coupled to the high voltage power supply 22 for eliminating the positive component of the DC offset AC waveform provided without the need for a high DC offset signal. This diode/resistor circuit acts as a rectifier circuit for eliminating or clipping the positive component of the oscillating AC voltage signal. As explained in Kunzmann, an exemplary embodiment in the art prior to Kunzmann comprises a bias charge roll input drive voltage having a peak-to-peak voltage of 1.6 kilovolts with a DC offset of minus 350 volts at a frequency of 400 hertz. Such an input drive signal will result in 450 volts of positive bias and 1150 volts of negative bias for delivering a photoreceptor surface potential of approximately minus 330 volts. By clipping the positive component of this typical AC input waveform, aggregate current flow to the surface of the photoreceptor can be reduced while maintaining required voltage levels. Such decreased current flow decreases the degradation and wear of the charge transport layer of photoreceptor member 12.

Unfortunately, while the single polarity clipped wave form taught by Kunzmann succeeds in increasing the photoreceptor surface potential with a lowered peak-to-peak voltage, the advantageous effects upon photoreceptor wear may be partially offset by creation of an oppositely charged corona proximate to the photoreceptor under certain conditions. Specifically, where the positive polarity has been clipped in the manner shown in Kunzmann, the resulting negative charge on the photoreceptor will induce a positive corona charge in proximity to the photoreceptor if the difference between the peak input voltage and the charge potential of the photoreceptor itself exceeds the Paschen threshold voltage. "Paschen threshold voltage" refers to the initial voltage at which a corona discharge is generated. The Paschen threshold voltage depends upon the geometry of the biased element generating the corona. For instance, the Paschen threshold voltage at which a typical BCR will begin generating a corona is about –600 V. For wire or pin arrays such as corotrons or scorotrons, the Paschen threshold voltage is likely to be in the range of –4 kV.

Figure 2:
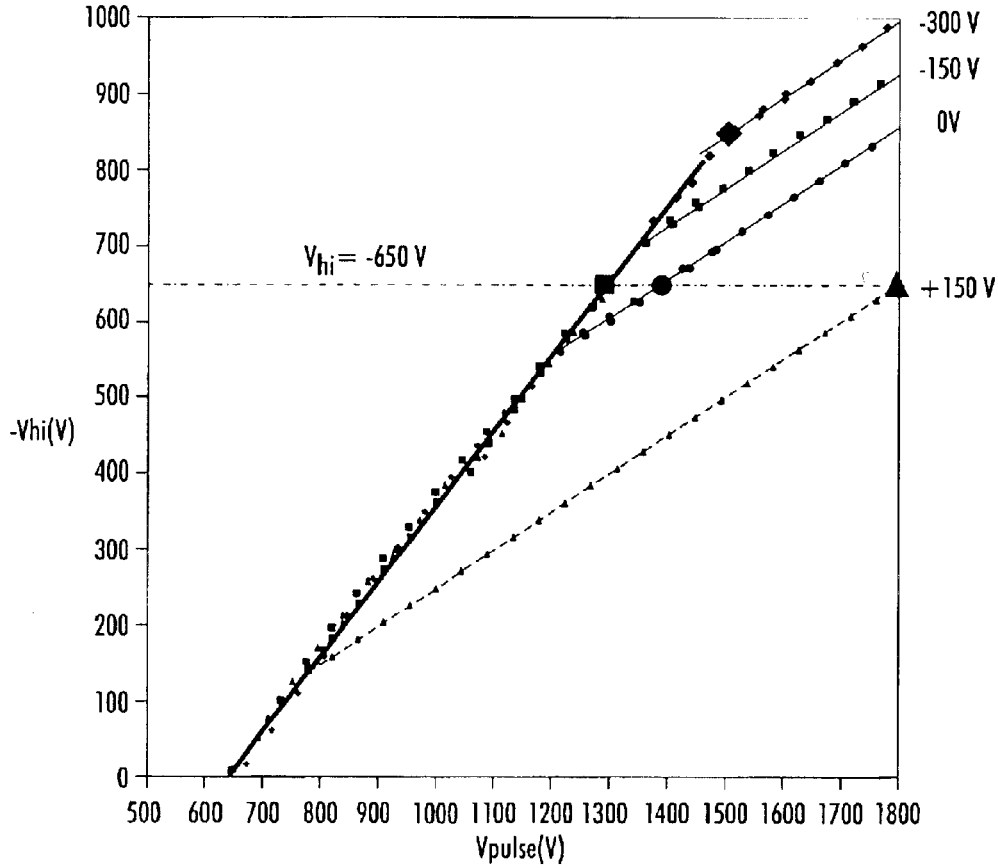
FIG. 2 is a graphical representation of photoreceptor voltage potentials graphed in relation to various rectified and unrectified AC input voltage signals with DC bias voltage applied to a charge roller charging apparatus.

With reference to FIG. 2, a graph of photoreceptor charge potential ($-V_{hi}$) versus the pulse amplitude of oscillating input voltage ($-V_{pulse}$) is shown. For those signals having a DC offset signal superimposed upon the $V_{pulse}$ signal, the DC-offset signal has the effect of shifting the peak-to-peak voltage ($V_{p-p}$) by the amount of the DC offset. The sinusoidal frequency for each curve is 1.3 kHz. Four curves are presented.

1. Simple DC offset AC. The enlarged triangle point represents a BCR input bias of 1800V peak-to-peak AC offset from ground by minus 650V. The line comprised of triangles (i.e., the bottom curve) represents the photoreceptor surface potentials at various pulse amplitudes. This curve is the equivalent of a clipped AC current as in Kunzmann when the DC offset potential is +400V
2. Clipped AC; no DC offset. The curve represented by circles is the curve generated by a signal configured as described in Kunzmann with a O Volt DC offset. The enlarged circle is at $V_{pulse}$=–1400V.
3. Clipped AC; negative DC offset. The curve represented by squares comprises a clipped AC with a negative DC offset of −150V. The enlarged square is on the DC-only line at $V_{pulse}$=−1300V 4. Clipped AC, increased negative DC offset. The top curve, represented by diamonds, shows results with a clipped AC and a −300V DC offset.

As expected, positive $V_{hi}$ values begin around −600 $V_{pulse}$ for all signals, at which point the Paschen threshold voltage is first surpassed. A negative corona begins once the Paschen threshold is surpassed, and this negative corona in turn induces the beginning of negative potential, $V_{hi}$ on the photoreceptor. Each curve then commences along essentially the same approximately 45-degree slope on this graph. This slope is the slope that would be obtained with a simple DC-only signal. The exact formula for this slope in this graph is $V_{hi}$=0.95*$V_{pulse}$−590, where $V_{pulse}$ equals the peak AC voltage attained if no DC offset is applied. Comparable graphs can be generated for any BCR system, and the specific shapes of the curves may vary depending upon BCR and photoreceptor specifics. In all cases, however, the general shape of curves shown in FIG. 2 is expected.

With reference first to the curve comprised of circles, representing a clipped AC with 0 DC-offset, $V_{pulse}$ equals $V_{pe-p}$ because there is no DC offset. Deviation from the DC-only curve begins around −550 $V_{hi}$ and −1180 $V_{pulse}$ because the difference between $V_{p-p}$ and $V_{hi}$ begins to exceed a second Paschen threshold voltage. In other words, when the corona generated by $V_{p-p}$ begins to differ enough from the voltage potential of the photoreceptor, $V_{hi}$, then the Paschen threshold voltage is again exceeded and a second corona is induced. In this instance, however, the corona has a positive charge. The reason is that with a clipped AC signal without a DC-offset, the clipped portion of the sinusoidal or square wave curve rests at 0V. Since the potential of the photoreceptor has fallen to −580 $V_{hi}$, the portion of the clipped AC signal around 0V is positive relative to the photoreceptor negative potential $V_{hi}$. The result is a momentary positive corona with a rapid switch back to a negative corona as the sinusoidal (or square wave) moves away form 0 V. The presence of a positive corona limits the rate at which $V_{hi}$ increases. As shown in FIG. 2, increases in $V_{pulse}$ after on-set of the second Paschen threshold voltage increases the proportion of positive corona in each sinusoidal or square wave cycle, and the curves in FIG. 2 deviate increasingly from the DC-only straight line curve.

With reference to the curve comprised of triangles, representing a standard unclipped oscillating AC signal with a positive DC offset, the second Paschen threshold voltage is exceeded at approximately −150 $V_{hi}$ and 750 $V_{pulse}$. This lower threshold voltage is due to the positive portion of the sinusoidal or square wave curve that is greater than the approximately 600 V difference that comprises the Paschen threshold voltage in this arrangement. As with the clipped AC curve without a DC-off-set, the positive portion of $V_{p-p}$ creates a positive corona relative to the $V_{hi}$ commencing at about −150 V $V_{hi}$ and the positive corona further increases as the AC voltage increase the deviation from the DC-only curve.

The curve comprised of squares represents one embodiment of the present invention. In this embodiment, a clipped AC signal is supplemented with a −150 V DC offset. The result is that the on-set of the second Paschen threshold voltage, compared to the circle-dot curve without a DC offset, commences at approximately −1400 $V_{pulse}$ and achieves a higher $V_{hi}$ of approximately −710 V before the second Paschen threshold is exceeded.

The curve comprised of diamonds is another example of a clipped AC signal with a DC offset. In this instance, the DC offset is increased to −300V, and the second Paschen threshold is not exceeded until $V_{hi}$ equals approximately −1470 V.

Figure 3:
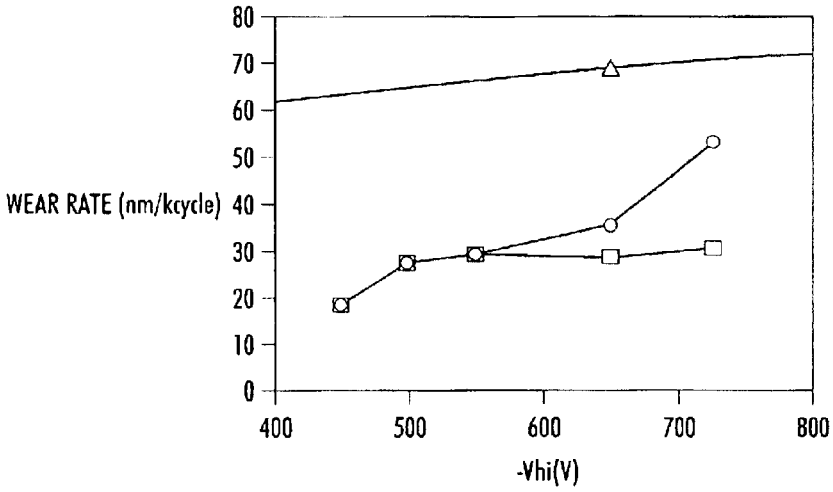
FIG. 3 is a graphical representation of the relationship between various rectified and unrectified AC input voltage signals with DC bias voltage applied to a charge roller charging apparatus.

With reference to FIG. 3, the impact upon typical rates of photoreceptor surface wear is shown for points along several of the curves shown in FIG. 2. The y-axis shows rates of wear measured in nanometers per 1000 revolutions, or cycles, of the photoreceptor. The X-axis shows values of $V_{hi}$. Each of the curves is determined in relation to photoreceptors meeting the same specifications.

The curve represented by squares corresponds to the curve of squares circles shown in FIG. 2. As shown in FIG. 3, photoreceptor wear is essentially flat at about 28 nm/1000 revolutions for $V_{hi}$ above −450 V, at least for the range of $V_{hi}$ shown. Referring again to FIG. 2, the curve of circles in FIG. 2 remains on the DC-only line until approximately −710 $V_{hi}$, which is essentially the entire range of $V_{hi}$ shown in FIG. 3. Thus, as long as the second Paschen threshold voltage is not exceeded, photoreceptor wear can be expected to be essentially constant.

In contrast, the curve in FIG. 3 comprised of circle dots slopes upward commencing at about −550 $V_{hi}$ . Referring again to FIG. 2, −550 $V_{hi}$ is approximately the voltage at which the second Paschen threshold voltage is reached. For each increase in $V_{hi}$ above this value, each clipped sinusoidal cycle produces increasing amounts of positive corona coupled with return to a negative corona. As explained above and in Kunzmann, such charging and discharging currents precipitate increased photoreceptor wear. The greater the amount of positive corona, the greater the wear.

The curve represented by triangles corresponds to the triangle curve shown in FIG. 2, which is an unclipped AC signal with a positive DC offset. Except for the data point indicated by the enlarged triangle, the values of this curve are estimated. As seen in the estimated curve, relatively high rates of wear occur throughout the entire range of $V_{hi}$ shown in FIG. 3 since, as indicated in FIG. 2, the entire range involves large charges and discharges between positive and negative corona.

Thus, for those imaging systems where high values of $V_{hi}$ are desired, the graphs comprising FIGS. 2 and 3 show that photoreceptor wear can be minimized if enough DC offset is applied to keep the resulting $V_{hi}$ vs. $V_{pulse}$ curve on the DC-only line, thereby avoiding onset of the second Paschen threshold. For any desired value of $V_{hi}$, the required amount of DC offset can be determined.

Figure 4:
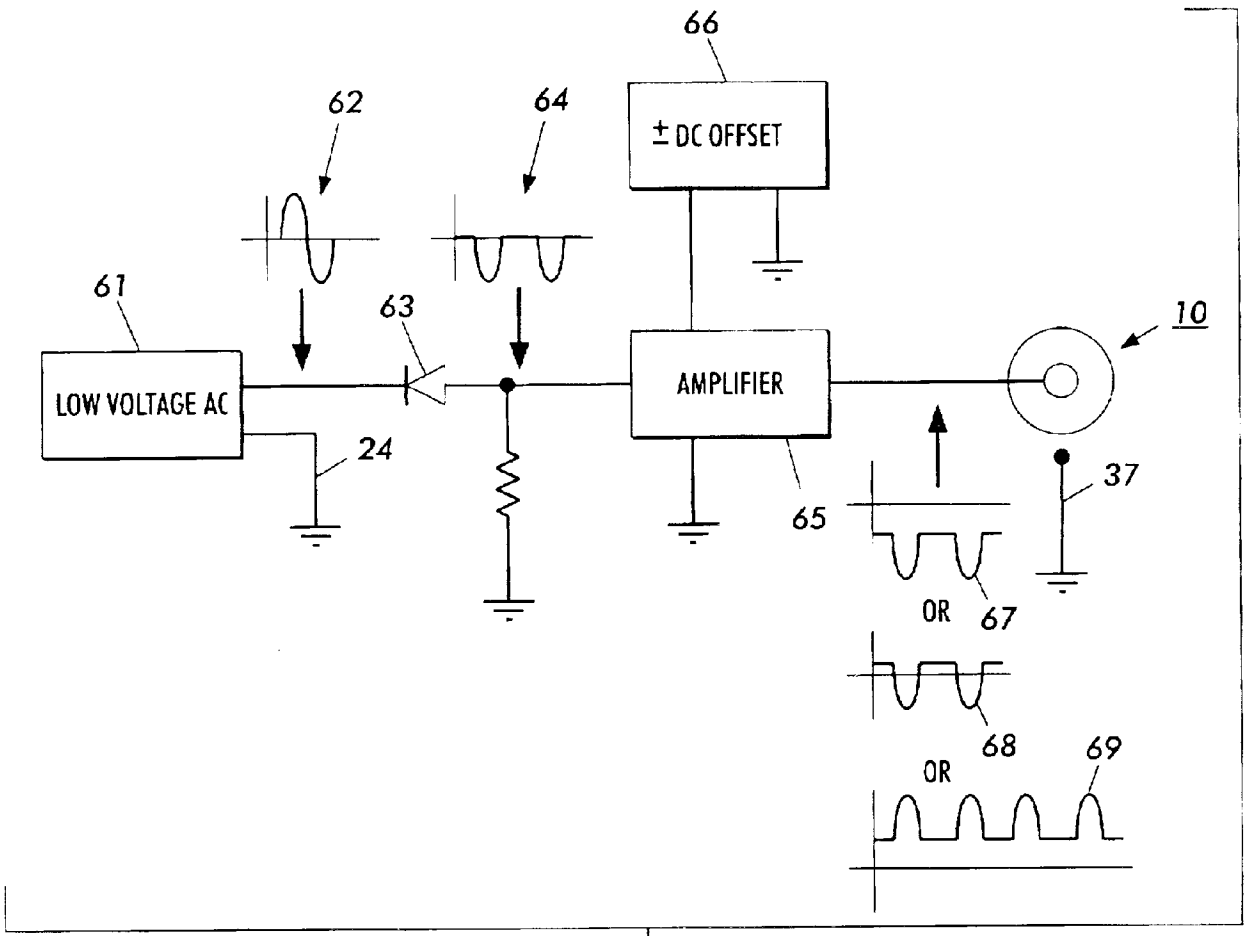
FIG. 4 is a schematic view of a one circuit embodiment of the present invention.

With reference to FIG. 4, one possible embodiment of a circuit capable of creating the waveforms in both FIGS. 2 and 3 is shown. Here, low voltage AC power source 61 provides an initial simple AC waveform 62. Rectifier 63 clips the oscillating waveform, resulting in clipped waveform 64. Amplifier 68 amplifies the signal, and DC power source 66 supplies either a positive or negative DC bias through amplifier 65. One skilled in the all will understand that many variations upon this circuit are possible, including using a high voltage AC power source instead of both low voltage AC power source 61 and amplifier 65. Regardless of the many possible embodiments of the circuit, the effect is to produce a clipped waveform with a superimposed DC bias.

When contrasted to the prior art circuit of FIG. 1, which is the circuit shown in FIG. 1 of Kunzmann, U.S. Pat. No. 5,613,173, one difference between the FIG. 4 embodiment of the present invention and the FIG. 1 prior art embodiment is the relationship of the DC offset signal to the DC rectifier 63. Although the signal in Kunzmann had a DC offset signal (See the title to Kunzmann, FIG. 3), this signal was superimposed prior to rectification of the oscillating signal. Confirmation of this placement of the DC offset signal is found in Kunzmann, FIG. 1, where there is only one signal source and the entire signal from that source is rectified by rectifier 63. More particularly, Kunzmann, FIG. 2, shows the resulting clipped waveform in Kunzmann which exhibits baseline rectification around 0 volts.

In contrast, the signal in FIG. 4 of the present invention is first rectified, as shown by signal waveform 64 and subsequently offset from a 0 Volt baseline by the DC offset. The result is a clipped oscillating waveform with a clipped baseline voltage moved away from the 0 Volt line. Signal 67 in FIG. 4 shows the result with a negative DC offset bias and signal 68 shows the result with a positive DC offset bias. In both signals, positive polarity was removed prior to superimposition of the DC-offset bias. Signal 69 shows the waveform result when a positive DC-offset is superimposed upon a clipped AC signal in which negative polarity has been rectified. Signal 69 (and the inverse signal to signal 68) are particularly significant for imaging systems in which the photoreceptor is positively rather than negatively charged. All of these signals, of course, differ from signal 64, which is the prior art signal of Kunzmann.

Referring again to FIG. 2, the ability of the present invention to increase $V_{hi}$ above −575 volts and particularly over −600 or −625 volts with a signal that remains on DC-only curve in FIG. 2 is novel. Typical unclipped AC waveforms such as the curve of triangles in FIG. 2 depart from the DC-only line at comparatively low $V_{hi}$ voltages. The teachings in Kunzmann succeeded in raising $V_{hi}$ voltages that remain on the DC-only line to about −550–575 volts. This is the level at which FIG. 3 in Kunzmann ceased. $V_{hi}$ voltages above this level become limited by the second Paschen threshold voltage as explained above. The Kunzmann patent entirely lacks any teaching of Paschen threshold voltages and, in particular, any teaching of multiple Paschen threshold voltages as embodied in the present invention. An understanding of such multiple Paschen threshold voltages and their impact upon the $V_{hi}$ vs. $V_{pulse}$ relationship results in the novel DC offset circuits of the present invention and the ability to achieve higher levels of $V_{hi}$ with less $V_{pulse}$ and, by avoiding positive corona discharges, the greatly advantageous decrease in photoreceptor wear.

For some imaging systems, desired image quality can be obtained using a BCR charge signal that keeps $V_{p\text{-}p}$ and $V_{hi}$ on the DC-only line. For many imaging systems, however, a small amount of AC corona provides more uniform charging of the photoreceptor within the nip region. See, Nakamura, U.S. Pat. No. 4,851,960. The trade-off becomes a balancing of the desire for low photoreceptor wear against the need or desire for some amount of AC corona. Such balance needs to be achieved at a specified level of $V_{hi}$. In BCRs with conventional AC oscillating voltages as exemplified by the curve of triangles shown in FIG. 2, achievement of acceptable uniformity comes at the high price of high photoreceptor wear, as shown in FIG. 3. Of the curves shown in FIG. 3, the most favorable wear curve is the curve of circles, which represents a curve that does not reach the second Paschen threshold voltage within the range of voltages shown in FIG. 3 and, therefore, remains on the DC-only line as shown in FIG. 2.

An examination of the curve comprised of circles in both FIGS. 2 and 3 yields important conclusions. With reference to FIG. 2, the large circular dot indicating $V_{hi}$ of −650 volts has passed the second Paschen threshold voltage for this signal, and sufficient AC corona exists for adequately uniform charging of the photoreceptor. With reference to FIG. 3, the same $V_{hi}$=−650 Volt square dot has increased its wear rate from approximately 28 nm/cycle to approximately 34 nm/cycle. This is expected since the second Paschen threshold has been exceeded. In comparison, the wear rate for the same −650 $V_{hi}$ level of the curve comprised of triangles, which exemplifies conventional unclipped AC signals, is approximately 70 nm/cycle. In other words, the wear rate of the −650 $V_{hi}$ square dot is 1.9 times less than the triangular dot at the same −650 $V_{hi}$ although both curves achieve an acceptable amount of AC corona. One embodiment of the present invention, therefore, is to select a level of $V_{p\text{-}p}$ that creates enough of an AC corona to achieve acceptable charge uniformity while at the same time minimizing photoreceptor wear.

The AC oscillating frequency also is a contributing determinant whether sufficient AC corona exists within the photoreceptor area being charged by the BCR. At imaging process speeds on the photoreceptor of between about 160–220 mm/sec, frequencies within a range from about 500 Hz to about 3 or 4 kHz are preferred. Frequencies between 1 and 2 kHz are most preferred. The lower limit of about 500 Hz is dictated by the onset of strobing. The upper limit is dictated by the electrical characteristics of the BCR, primarily the relaxation time. The relaxation time is related to the time required for charge to get from the shaft of the BCR to its surface. Within the preferred frequency range of 1–2 kHz, the curves in FIGS. 2 and 3 are not significantly affected by frequency, and charging will be sufficiently uniform for good print quality. With respect to the wear curves of FIG. 3, frequency has no effect upon the wear curves for $V_{hi}$ VS. $V_{pulse}$ relationships in which the second Paschen threshold voltage is not exceeded. Once the second Paschen threshold voltage is exceeded, frequency may affect photoreceptor wear slightly by about a few nanometers per kilocycle.

Figure 5:
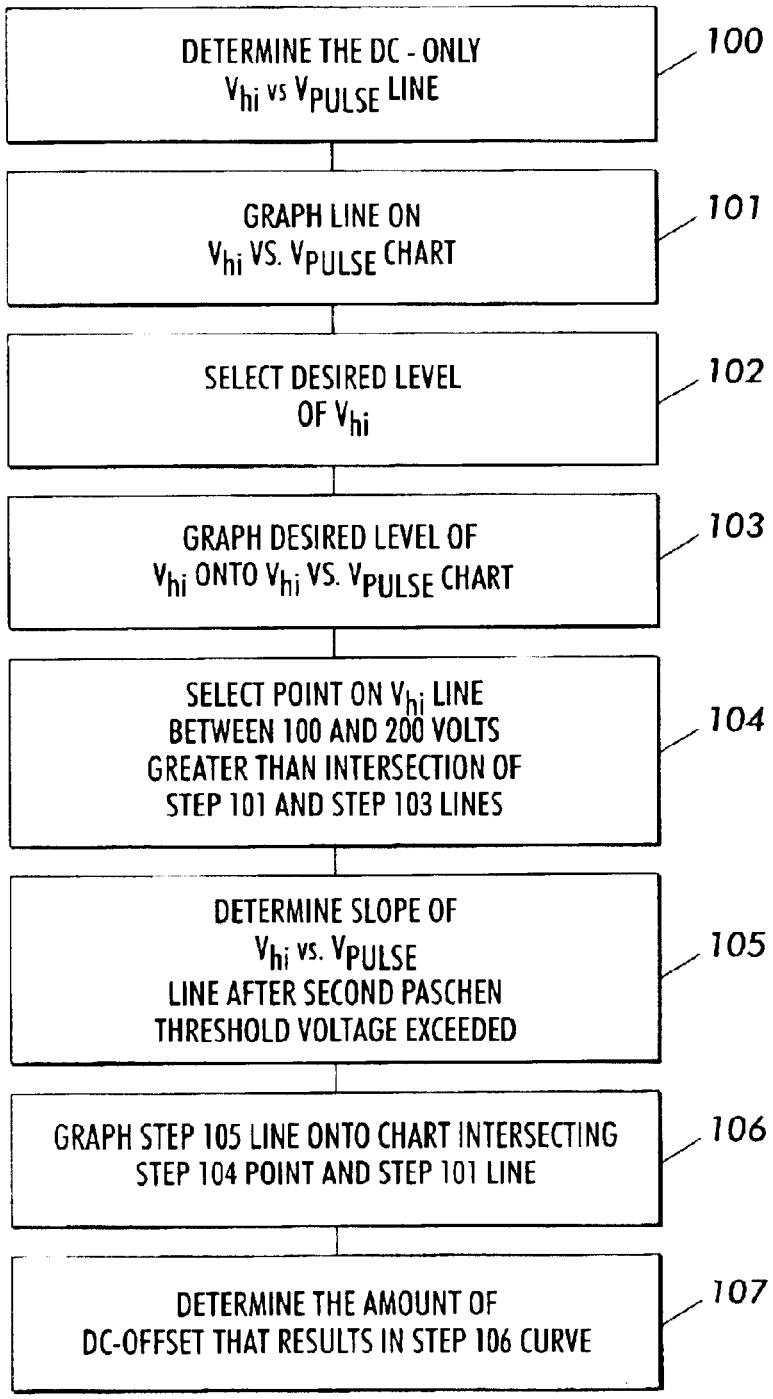
FIG. 5 is a block diagram of one embodiment of a process of the present invention.

A process for balancing a required amount of AC corona while maintaining photoreceptor wear at an acceptable minimum is shown in FIG. 5. The goal is to select a variable voltage input signal that produces minimally sufficient alternating polarity corona for uniformly charging the photoreceptor in order that photoreceptor wear is thereby minimized. The process of FIG. 5 will be explained in relation to the graph in FIG. 2. At step 100 in FIG. 5, the process may begin with determination of the DC-only relationship between $V_{hi}$ and $V_{pulse}$ for the particular BCR and photoreceptor combination. At step 101, the DC-only $V_{hi}$ vs. $V_{pulse}$ line is graphed onto a chart similar to FIG. 2 with suitable ranges of $V_{hi}$ and $V_{pulse}$. At step 102, a level of $V_{hi}$ desired for the imaging system is selected. This level of $V_{hi}$ is generally selected based upon the characteristics of the imaging system, including the toner to be used, the development apparatus, and preferred charging voltages for toner and development. With both a desired level of $V_{hi}$ and the slope of the DC-only $V_{hi}$ and $V_{pulse}$ line determined, step 103 provides for drawing a horizontal line equal to the value of $V_{hi}$ on a graph similar to the horizontal dotted line in FIG. 2 at $V_{hi}$=−650 volts. A desired amount of AC corona can then be selected based upon a balancing that minimizes the amount of photoreceptor wear while generating sufficient AC corona for any given frequency of signal. Generally, at step 104, the desired balance between photoreceptor wear and AC corona will be achieved by locating a selected point on the horizontal $V_{hi}$ line from about 100 to about 200 $V_{pulse}$ volts greater than the intersection between the horizontal $V_{hi}$ line and the DC-only $V_{hi}$ and $V_{pulse}$. More preferably, this range is between 130 and 170 volts greater than the intersection point. Once the point within the above range on the horizontal $V_{hi}$ line is selected, then, at step 105, the slope is calculated or experimentally determined of the $V_{hi}$ vs. $V_{pulse}$ line for the portion after the second Paschen threshold voltage is exceeded. At step 106, this line in graphed onto the chart at its location in which it intersects the selected point on the horizontal $V_{hi}$ line. As can be seen from each of the curves graphed in FIG. 2, the post-second Paschen threshold line intersects the DC-only line at a $V_{hi}$ value less than the horizontal $V_{hi}$ line. At step 107, the amount of DC-offset, if any, is determined that results in the $V_{hi}$ vs. $V_{pulse}$ curve comprised of a portion of the DC-only line plus the line determined at step 106 that intersects the selected point on the horizontal $V_{hi}$ line.

Those skilled in the art will recognize multiple alternatives to the above process. Although described as a process using graphs, the above process can be completed using mathematical relationships rather than curves and graphs. Another alternative determines the slope of the post-second Paschen threshold curve and then selects a point on the DC-only $V_{hi}$ vs. $V_{pulse}$ line at which the post-second Paschen threshold curve should intersect the DC-only line. Generally, this point of intersection on the DC-only line is between within about 150 and, more preferably, within about 50 and 120 $V_{hi}$ volts from the desired level of $V_{hi}$. In FIG. 2, the desired level of $V_{hi}$ is −650 volts, and the range of $V_{hi}$ values for the desired intersection is between −530 and −600 volts.

The process explained above for optimizing a desired amount of AC corona with acceptably minimized photoreceptor wear will be of significant use with a clipped AC waveform with a DC offset superimposed on the signal after rectification of the signal. As shown in FIG. 2, however, the process of the present invention may also be used to select $V_{pulse}$ values for unclipped AC signals and for rectified AC waveforms similar to those taught in the Kunzmann patent where the waveform is rectified after a DC offset signal is superimposed on the AC waveform.

In review, the foregoing description discloses an apparatus for applying an electrical charge to a photoreceptor wherein a bias contact roll member is situated in contact or in close proximity (with a surface of member to be charged such as a photoreceptor. The bias contact roll member is supplied with an electrical bias having a clipped AC waveform onto which a DC bias is superimposed. The amount of DC bias is selected to set $V_{pulse}$ such that the second Paschen threshold voltage is exceeded by only a small amount, thereby producing an acceptable amount of AC corona to provide uniform photoreceptor charging while preventing excessive positive corona that harms the useful life of a photoreceptor by inducing degrading discharges between the corona and photoreceptor.

It is, therefore, apparent that there has been provided, in accordance with the present invention, a biased roll charging device that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

We claim:

1. An apparatus for applying an electrical charge to a member to be charged, comprising:

a. a charge roll member situated proximately to a surface of the member to be charged;

b. a power supply for supplying an oscillating voltage signal to the charge roll member;

c. a device, interposed between the power supply and the charge roll member, for removing a selected polarity component of the oscillating voltage signal, thereby supplying a voltage signal to the charge roll member comprised of a rectified waveform with a DC bias offset; wherein a first and second Paschen threshold voltage exist between the charge roll member and a member to be charged;

wherein a portion of the voltage signal exceeds the first Paschen threshold voltage, thereby inducing a corona of the same polarity as the rectified waveform; and wherein a portion of the voltage signal exceeds the second Paschen threshold voltage, thereby inducing a corona of the opposite polarity of the rectified waveform.

2. The apparatus of claim 1, further comprising a DC power source for superimposing a DC bias signal upon the rectified oscillating voltage signal, wherein a voltage signal comprised of a rectified waveform with a DC bias offset is supplied to the charge roll member.

3. The apparatus of claim 2, wherein the rectifying device removes the positive polarity of the oscillating voltage signal.

4. The apparatus of claim 2, wherein the DC power source superimposes a negative polarity DC bias.

5. The apparatus of claim 2, wherein the DC power source superimposes a positive polarity DC bias.

6. The apparatus of claim 1, wherein the rectifying device comprises a diode.

7. The apparatus of claim 1, wherein the member to be charged has a voltage potential and wherein the voltage signal is selected to maintain the voltage potential of the member to be charged within about 150 volts of a voltage potential present at the onset of the second Paschen threshold voltage.

8. The apparatus of claim 7, wherein the voltage potential of the voltage signal is selected to maintain the Voltage potential of the member to be charged between about 50 and 120 volts of a voltage potential present at the onset of the second Paschen threshold voltage.

9. The apparatus of claim 1, wherein the voltage signal has a peak-to-peak voltage and wherein the voltage signal is selected to maintain the peak-to-peak voltage within about 200 volts of a peak-to-peak voltage present at the onset of the second Paschen threshold voltage.

10. The apparatus of claim 9, wherein the voltage signal is selected to maintain a peak-to-peak voltage present between about 130 and 170 volts of the peak-to-peak voltage at the onset of the second Paschen threshold voltage.

11. An apparatus for applying an electrical charge to a member to be charged, comprising:

a. a charge roll member situated proximately to a surface of the member to be charged; and b. a power supply for supplying an oscillating polarity voltage signal to the member to be charged;

wherein a first and a second Paschen threshold voltage exist between the charge roll member and the member to be charged;

wherein a portion of the voltage signal exceeds the first Paschen threshold voltage, thereby inducing a first corona of the same polarity as the portion of the voltage signal that exceeds the first Paschen threshold voltage; and wherein a portion of the voltage signal exceeds the second Paschen threshold voltage by not more than about 200 volts, thereby inducing a corona of opposite polarity from the first corona.

12. The apparatus of claim 11, wherein a maximum voltage amount by which the voltage signal exceeds the second Paschen threshold voltage is from about 130 to about 170 volts.

13. The apparatus of claim 11, further comprising a DC power source for superimposing a DC bias signal upon the oscillating voltage signal wherein an oscillating polarity voltage signal comprised of a DC bias offset is supplied to the charge roll member.

14. The apparatus of claim 11, wherein the member to be charged has a voltage potential and wherein the voltage signal is selected to maintain the voltage potential of the member to be charged within about 150 volts of voltage potential present at the onset of the second Paschen threshold voltage.

15. The apparatus of claim 11, wherein the voltage potential of the voltage signal is selected to maintain the voltage potential of the member to be charged between about 50 and 120 volts of a voltage potential present at the onset of the second Paschen threshold voltage.

16. An electrostatographic imaging system, comprising:

a. a member to be charged;

b. a charge roll member situated proximately to a surface of the member to be charged:

c. a power supply for supplying an oscillating voltage signal to the charge roll member, and d. a device for removing a selected polarity component of the oscillating voltage signal, thereby supplying a voltage signal to the charge roll member comprised of a rectified waveform with a DC bias offset;

wherein a first and a second Paschen threshold voltage exist between the charge roll member and the member to be charged;

wherein a portion of the voltage signal exceeds the first Paschen threshold voltage, thereby inducing a corona of the same polarity as the rectified waveform, and wherein a portion of the voltage signal exceeds the second Paschen threshold voltage, thereby inducing a corona of the opposite polarity of the rectified waveform.

17. A process for applying an electrical charge to a member to be charged, comprising:

a. determining a first relationship between a voltage potential of the member to be charged and various levels of direct current voltage signals supplied to a charge roll member situated in proximity to a surface of the member to be charged;

b. selecting a desired level of voltage potential of the member to be charged;

c. identifying a second relationship between the voltage potential of the member to be charged and various levels of input voltage signals that comprise variable voltage components in which a portion of the voltage signal exceeds a second Paschen threshold voltage, said variable voltage signals being supplied to the charge roll member situated in proximity to the surface of the member to be charged;

d. combining the first relationship and the second relationship to determine various variable voltage signals that achieve the selected desired level of voltage potential of the member to be charged;

e. choosing the variable voltage signal that provides essentially minimally sufficient alternating polarity corona for uniformly charging the member to be charged.

18. The process of claim 17, wherein choosing the variable voltage signal that provides essentially minimally sufficient alternating polarity corona further comprises choosing a variable voltage signal wherein the maximum voltage amount by which the voltage signal exceeds a second Paschen threshold voltage is less than 200 volts.

19. The process of claim 17, wherein choosing the input voltage signal that provides essentially minimally sufficient alternating polarity corona further comprises choosing a variable voltage signal wherein the maximum voltage amount by which the voltage signal exceeds a second Paschen threshold voltage is from about 130 to about 170 volts.

20. The process of claim 17, wherein choosing the variable voltage signal that provides essentially minimally sufficient alternating polarity further comprises choosing a variable voltage signal wherein the second relationship relating to said variable voltage signal intersects the first relationship at a voltage potential of the member to be charged within about 150 volts of the selected desired level of voltage potential of the member to be charged.

21. The process of claim 17, wherein choosing the variable voltage signal that provides essentially minimally sufficient alternating polarity further comprises choosing a variable voltage signal wherein the second relationship relating to said variable voltage signal intersects the first relationship at a voltage potential of the member to be charged between about 50 and about 120 volts of the selected desired level of voltage potential of the member to be charged.

* * * * *